US009849484B2

(12) United States Patent
Guenther

(10) Patent No.: US 9,849,484 B2
(45) Date of Patent: Dec. 26, 2017

(54) DEVICE FOR SORTING

(71) Applicant: Guenther Holding GmbH & Co. KG

(72) Inventor: Bernd Guenther, Wartenberg (DE)

(73) Assignee: GUNTHER HOLDING GMBH & CO. KG (DE)

( * ) Notice: Subject to any disclaimer, the term of this patent is extended or adjusted under 35 U.S.C. 154(b) by 0 days.

(21) Appl. No.: 14/439,302

(22) PCT Filed: Oct. 30, 2013

(86) PCT No.: PCT/EP2013/072674
§ 371 (c)(1),
(2) Date: Apr. 29, 2015

(87) PCT Pub. No.: WO2014/067979
PCT Pub. Date: May 8, 2014

(65) Prior Publication Data

US 2015/0290681 A1 Oct. 15, 2015

(30) Foreign Application Priority Data

Oct. 30, 2012 (DE) ..... 10 2012 110 361

(51) Int. Cl.

| | |
|---|---|
| ***E02F 3/40*** | (2006.01) |
| ***B07B 1/14*** | (2006.01) |
| ***B07B 1/15*** | (2006.01) |
| ***E02F 7/06*** | (2006.01) |
| ***E02F 3/407*** | (2006.01) |

(52) U.S. Cl.
CPC ..... *B07B 1/145* (2013.01); *B07B 1/15* (2013.01); *E02F 3/407* (2013.01); *E02F 7/06* (2013.01)

(58) Field of Classification Search
CPC .. B07B 1/145; B07B 1/14; B07B 1/15; B07B 1/16; B07B 1/12; B07B 1/005; E02F 3/407; E02F 7/06
(Continued)

(56) References Cited

U.S. PATENT DOCUMENTS 1,408,799 A * 3/1922 Mott ..... B07B 1/14 209/393
2,618,385 A * 11/1952 Silver ..... B07B 13/00 209/629
(Continued)

FOREIGN PATENT DOCUMENTS

DE 3024046 A1 2/1981
DE 3724240 A1 * 2/1989 ..... B07B 13/006
(Continued)

OTHER PUBLICATIONS

Int'l Search Report dated May 23, 2014 in Int'l application No. PCT/EP2013/072674.
(Continued)

*Primary Examiner* — Thomas B Will
*Assistant Examiner* — Joan D Misa
(74) *Attorney, Agent, or Firm* — Rogowski Law LLC

(57) ABSTRACT

The invention relates to a device for sorting particulate materials of different grain size that can be part of a construction machine or digger's scoop. The device for sorting has a plurality of helical rollers, each exhibiting at least one helix, wherein each helical roller rotates about a rotary axis of its own, at least two adjacent helical rollers exhibit the same direction of rotation, and the rotary axes of at least three helical rollers are not arranged in a common plane. At least some of the helical rollers are held and rotatably mounted exclusively at one end.

16 Claims, 14 Drawing Sheets

(58) Field of Classification Search
USPC ..... 37/444
See application file for complete search history.

(56) References Cited

U.S. PATENT DOCUMENTS

| | | | | | |
|---|---|---|---|---|---|
| 2,966,267 | A * | 12/1960 | Dunbar | B07B 1/15 | 209/233 |
| 3,721,345 | A * | 3/1973 | Brown | B07B 1/4636 | 209/669 |
| 4,377,474 | A * | 3/1983 | Lindberg | B07B 1/15 | 209/279 |
| 4,430,210 | A | 2/1984 | Tuuha | | |
| 4,471,876 | A * | 9/1984 | Stevenson, Jr. | A01D 17/06 | 15/3.11 |
| 4,755,286 | A * | 7/1988 | Bielagus | D21B 1/023 | 209/243 |
| 5,024,335 | A * | 6/1991 | Lundell | B03B 9/061 | 209/615 |
| 5,298,119 | A * | 3/1994 | Brown | B07B 1/15 | 162/55 |
| 5,360,119 | A * | 11/1994 | Nakamura | A23N 12/005 | 209/618 |
| 5,373,947 | A * | 12/1994 | Nakamura | B07B 1/145 | 209/618 |
| 6,108,945 | A * | 8/2000 | Cronk, Jr. | E02F 3/40 | 37/142.5 |
| 6,237,865 | B1 * | 5/2001 | Luttermann | B02C 13/2804 | 241/101.72 |
| 6,648,145 | B2 | 11/2003 | Davis et al. | | |
| 7,007,877 | B1 * | 3/2006 | Kuhmonen | B07B 1/005 | 241/236 |
| 7,066,706 | B2 * | 6/2006 | Risch | E02F 3/3677 | 37/444 |
| 7,445,122 | B2 * | 11/2008 | Currey | B07B 1/15 | 209/671 |
| 7,549,544 | B1 * | 6/2009 | Currey | B07B 1/15 | 209/662 |
| 7,913,430 | B2 * | 3/2011 | Mannikko | B02C 13/13 | 241/101.72 |
| 7,954,263 | B2 * | 6/2011 | Mannikko | B01F 7/002 | 241/157 |
| 8,074,914 | B2 * | 12/2011 | Mannikko | B02C 18/14 | 241/101.72 |
| 8,122,620 | B2 * | 2/2012 | Mannikko | E02F 3/407 | 241/157 |
| 8,360,249 | B1 * | 1/2013 | Currey | B07B 1/15 | 209/671 |
| 8,893,409 | B1 * | 11/2014 | Rossi, Jr. | E02F 7/06 | 209/660 |
| 9,080,314 | B1 * | 7/2015 | Rossi, Jr. | B07B 1/46 | |
| 2004/0050987 | A1 * | 3/2004 | Rossi, Jr. | B02C 1/02 | 241/101.77 |
| 2006/0242864 | A1 | 11/2006 | Jonninen | | |
| 2015/0267376 | A1 * | 9/2015 | Sager | E02F 7/06 | 37/444 |

FOREIGN PATENT DOCUMENTS

| | | | | | |
|---|---|---|---|---|---|
| DE | 202006005070 | U1 | 6/2006 | | |
| DE | 60218668 | T2 | 11/2007 | | |
| EP | 1287730 | A1 * | 3/2003 | | A01D 17/06 |
| EP | 1570919 | A1 | 9/2005 | | |
| EP | 1702509 | A2 | 9/2006 | | |
| EP | 2329891 | A1 | 6/2011 | | |
| EP | 2933028 | A1 * | 10/2015 | | B07B 1/005 |
| GB | 2239156 | A * | 6/1991 | | A01D 17/06 |
| GB | 2239157 | A * | 6/1991 | | A01D 17/06 |

OTHER PUBLICATIONS

German Communication dated Nov. 25, 2014.
German Communication dated Feb. 4, 2013.
German Communication dated Dec. 12, 2013.

* cited by examiner

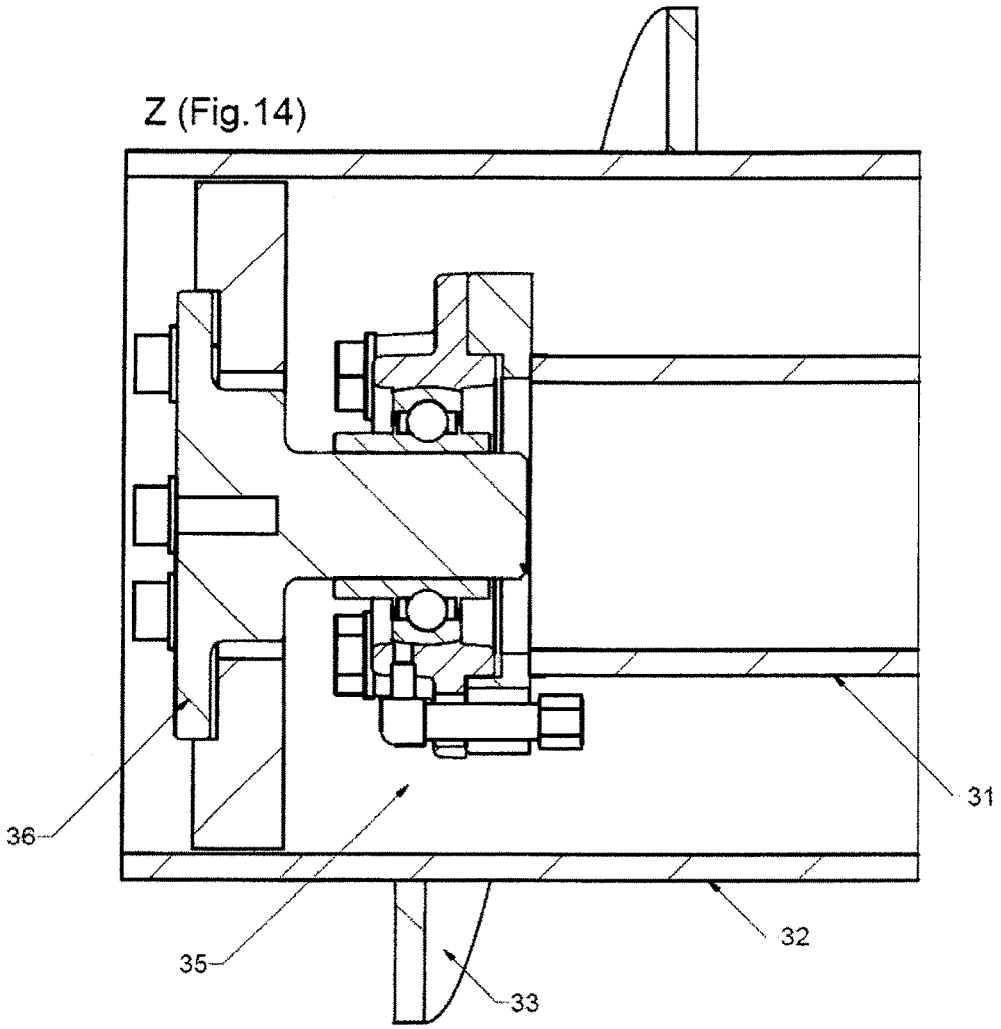
Z (Fig.14)
36
35
33
32
31

DEVICE FOR SORTING

CROSS-REFERENCE TO RELATED APPLICATIONS

This application is a national stage application (under 35 USC §371) of PCT/EP2013/072674, filed Oct. 30, 2013, which claims benefit of German application 10 2012 110 361.5, filed Oct. 30, 2012.

BACKGROUND OF THE INVENTION

Technical Field and State of the Art

The invention relates to a device for sorting, comprising a plurality of helical rollers, each exhibiting at least one helix, wherein each helical roller rotates about a rotary axis of its own, at least two adjacent helical rollers exhibit the same direction of rotation, and the rotary axes of at least three helical rollers are not arranged in a common plane.

The invention also relates to a digger and a digger's scoop comprising such a device for sorting.

EP 2 329 891 A1 discloses a device comprising the features cited at the beginning. Although this application focuses substantially on a sorting device which is designed as a disc screen and arranged at an inclination, the discs can however also be designed in accordance with one modification as propeller-like discs which drive the material not only in the circumferential direction of the rotation of the discs but also orthogonally to it, in the direction of the rotary axis of the rotary elements. This, however, makes it more difficult or even completely impossible to transport the oversize grain away in the direction of the rotary axis past the bearing sides of the rotary elements which are mounted at both ends.

DE 10 2010 030 507 A1 discloses a device for sorting, comprising a plurality of rotary elements which are designed as helical rollers, each exhibiting at least one helix, and each of which rotates about a rotary axis of its own, wherein at least two adjacent helical rollers exhibit the same direction of rotation.

DE 602 18 668 T2 discloses a sorting device, which is designed in a V shape as a disc screen, for mixed recyclable material. The free ends of the rotary elements of the disc screen are mounted at both ends in a frame.

EP 1 570 919 B1 discloses a device of the type cited at the beginning, for sorting substantially solid materials. In one specific embodiment of this device, material to be separated is introduced, via a feed belt and at a particular angle, onto a plurality of spiral rollers which are driven in the same rotational direction. The material is conveyed in the longitudinal direction by a runway effect and simultaneously sideways by the spiral helix, wherein any parts which are smaller than the intermediate spaces, which are predetermined by the design, fall down between the spiral helices. Long, thin parts are discharged in the rotational direction and thick, cubical shaped parts are discharged via the freely terminating shaft ends. The so-called fine grain which falls through the intermediate spaces can be directly transported away by suitable conveyor belts below the spiral rollers, as can the two coarse materials.

BRIEF SUMMARY OF THE INVENTION

It is an object of the present invention to specify a device for sorting which enables the oversize grain to be sorted and in particular also transported away in an improved way.

This object is solved by a device of the type cited at the beginning, which is characterised in that at least some of the helical rollers are held and rotatably mounted exclusively at one end.

It has been found that the sorting result can be improved by being able to exert an additional force on the sorting material—in particular by utilising (utilizing) its weight—in particular regions of a sorting surface formed by the helical rollers. The force can for example be directed towards the lowest point on a sorting surface which is designed in the shape of a depression. This achieves an improved sorting result, since the unsorted material is available to the sorting process for longer. This in particular reduces the likelihood of an undersize grain, which should in fact fall down between the helical rollers, inadvertently leaving the device for sorting via the exit path for the oversize grain when it is exposed to the influence of the rotary elements, which are embodied as helical rollers or spiral rollers, by a repelling weight component. In accordance with the invention, at least some of the rotary elements, which are designed as helical rollers or spiral rollers, are held and rotatably mounted exclusively at one end. Consequently, the oversize grain can be expelled via the free ends of these rotary elements, while the undersize grain falls through the rotary elements. In addition, it is also possible to stipulate that the elongated portions of the sorting material are transported past the sorting surface and expelled in a straight direction.

In one preferred embodiment, the rotary axes of the rotary elements are orientated parallel to each other.

In one particular device for sorting, it is stipulated that the sorting surface formed by the rotary elements is curved in a partial region. The curve can in particular be designed with a cross-section in the shape of a circular portion or parabola, or also a V shape.

Alternatively or additionally, it is also advantageously possible for the sorting surface formed by the rotary elements to be curved in one partial region and designed so as to be level in another partial region. It is in particular possible to stipulate that the sorting surface formed by the rotary elements is designed so as to be level in a region onto which the unsorted material is introduced, and is curved and in particular gradually rises in a region for expelling the oversize grain which lies opposite the introducing region. This advantageously means that the sorting material which has traversed the level sorting surface then has an additional force component exerted on it by the curved part of the sorting surface, which repels the sorting material onto the sorting surface. This achieves a particularly good sorting result, since—as already stated—the part of the sorting material which should in fact fall down between the rotary elements, which can for example be embodied as helical rollers or screen star rollers, remains in their region of influence for longer, thus increasing the likelihood of them falling through as desired. This ultimately improves the sorting result significantly. This also in particular enables parts of the sorting material which are stuck together to be separated.

As already briefly mentioned, it is advantageously possible to stipulate that the sorting surface formed by the rotary elements forms a depression and/or is part of a depression. In addition to the rotary elements, at least one additional limiting wall can be provided in order to form the depression.

In one embodiment of a device in accordance with the invention which sorts to a very particular level of accuracy, at least two rotary elements exhibit different directions of rotation. It is in particular possible to stipulate that the rotary elements in a first partial region exhibit a first direction of rotation and the rotary elements in a second partial region which is different from the first partial region exhibit a direction of rotation which is opposite to the first direction of rotation. It is for example advantageously possible to stipulate that all the rotary elements exhibit a direction of rotation such that the side of the rotary elements directed towards the material to be sorted always exerts a force on the sorting material which is for example directed towards a centre (center) of the sorting surface and/or a lowest point on a depression.

In one particular embodiment, it is stipulated that the helices of the spiral rollers in a first partial region of the sorting surface exhibit a different coiling direction to the helices of the spiral rollers in a second partial region of the sorting surface which is different from the first partial region. It is in particular also possible to stipulate that the helices of mutually adjacent spiral rollers in a first partial region of the sorting surface of the device exhibit a different coiling direction to the helices of mutually adjacent spiral rollers in a second partial region of the sorting surface which is different from the first partial region.

However, an effect of transporting the material to be sorted along the sorting surface due to the runway effect is only achieved when a plurality of consecutive rotary elements (for example in a partial region of the sorting surface or over the entire sorting surface) exhibit the same direction of rotation. This desired transporting effect would not occur if the adjacent rotary elements exhibit alternately opposite directions of rotation. It is therefore stipulated in accordance with the invention that at least two adjacent rotary elements and preferably more than two consecutive rotary elements exhibit the same direction of rotation.

In one particular embodiment, it is stipulated that the helices of the spiral rollers interlock at least in a partial region and/or that the helices of the spiral rollers of the partial regions of the sorting surface each interlock in the same direction of rotation and/or that the helices of all mutually adjacent spiral rollers interlock.

In one particular embodiment, a direction for introducing the material to be sorted is defined which is orientated parallel to the rotary axis of at least one rotary element. It is in particular possible to stipulate that a region for introducing the sorting material is defined by adjacent ends of the rotary elements. It is particularly advantageously possible to stipulate that a region for introducing the sorting material is defined in the region of the ends at which the rotary elements are held at one end.

Alternatively, it is also possible to stipulate that a direction for introducing the material to be sorted is defined which is orientated perpendicular to the rotary axis of at least one rotary element. In this respect, it is in particular possible to stipulate that the sorting material is introduced laterally onto one or more rotary elements and then transported over the sorting surface by the rotary elements due to the runway effect described above.

In a very particularly advantageous embodiment of the device in accordance with the invention, it is stipulated that the sorting surface formed by the rotary elements can be pivoted as a whole. Pivoting can in particular be used to position individual regions of the sorting surface more steeply and other regions more flatly. For this purpose, it is in particular possible to stipulate that the sorting surface formed by the rotary elements is mounted such that it can be pivoted about a pivot axis which is parallel to the rotary axes. An ability to pivot in this way can also be used to load the device for sorting with sorting material and/or to effect a loading position, for example when the device for sorting is part of a digger's scoop.

It is also possible, for example in order to make it more difficult to expel the sorting material via the free ends of the spiral rollers by adding an additional weight component, for the sorting surface formed by the rotary elements to be mounted such that it can be pivoted as a whole about a pivot axis arranged in a plane which is perpendicular to the rotary axes. In this way, the force directed onto the sorting material towards the free end of the spiral rollers by the rotation of the spiral rollers which are provided with helices, is opposed by a weight component which causes the sorting material to have a longer dwelling time on the sorting surface. This improves the sorting result as a whole. It is however also possible, for example when a large amount of sorting material is to be processed within a short period of time, to incline the sorting surface in the opposite direction in order to achieve a high throughput, albeit at a reduced sorting quality.

In accordance with one independent and self-contained concept of the invention, it is stipulated that the helical rollers which are held and/or rotatably mounted at one end comprise a core tube which is preferably fixed and on which an outer tube casing is rotatably mounted which bears the helix and/or spiral. This embodiment, comprising a core tube which is preferably stationary and surrounded by a tube casing which bears the helix and/or spiral, is particularly advisable for larger-designed devices. The core tube and the outer tube casing are mounted at at least two points. The tube casing is effectively mounted at both ends; the tube casing is effectively mounted at both ends. This internal design substantially reduces oscillations and imbalances within the helical rollers and/or spiral rollers.

The core tube can then extend into the tube casing over only some of the length of the tube casing. The core tube can for example protrude into the tube casing up to at least half the length of the tube casing.

In accordance with another embodiment of the invention, it is stipulated that the mounting between the core tube and the tube casing is arranged in the region of the drive for the helical roller such that the forces coming from the drive are introduced particularly economically into the helical roller, without causing increased material stress.

In accordance with one self-contained and independent concept of the invention, it is stipulated that a digger's scoop is fitted with a device for sorting, in particular a device in accordance with the invention.

Such a digger's scoop can comprise all the features of the device for sorting described above, wherein it need not however necessarily be stipulated that the rotary axes of at least three rotary elements are not arranged in a common plane. The digger's scoop can instead also be designed such that the rotary axes of all the rotary elements are arranged in a common plane.

The embodiment of the digger's scoop in which the sorting surface formed by the rotary elements is curved at least in a partial region is however particularly advantageous, since the digger's scoop can be designed so as to be curved in the region of its base, which makes it easier to perform a shoveling movement in order to fill the digger's scoop.

It is then in particular possible to stipulate that the digger's scoop comprises a filling opening and an opening for expelling the oversize grain which is different from the filling opening. In addition, it is possible to stipulate that the digger's scoop comprises another path for expelling the undersize grain, wherein this expelling path generally extends through the intermediate spaces between the rotary elements.

The digger's scoop is preferably designed for sorting only and not for example for crushing the material received by the digger's scoop.

In one advantageous embodiment, the digger's scoop comprises at least one partition wall which keeps the fractions produced by the device for sorting separate from each other. Alternatively or additionally, it is also in particular possible to stipulate that the rotary elements terminate freely and that the digger's scoop comprises at least one partition wall which is arranged below the free ends of the rotary elements when the digger's scoop is in its operational position for sorting and/or that the digger's scoop comprises at least one partition wall which is arranged below the opening for expelling the oversize grain when the digger's scoop is in its operational position for sorting.

This ensures in particular that the fractions do not recombine below the digger's scoop.

The digger's scoop can comprise a drive device of its own for rotary-driving the rotary elements. It is in particular possible to stipulate that the drive device is designed hydraulically, for example by utilising (utilizing) the hydraulic pumps, fluids and conduits which in most cases are provided on a digger anyway. A construction machine, in particular a digger, comprising a device for sorting in accordance with the invention and/or comprising a digger's scoop which is embodied as has been described is particularly advantageous.

Other aims, advantages, features and possible applications of the present invention may be gathered from the following description of an example embodiment on the basis of the drawings, wherein any of the described and/or illustrated features, in their own right or in any expedient combination, form the subject-matter of the present invention, including independently of their recapitulation in the claims or the dependency of said claims.

BRIEF DESCRIPTION OF THE SEVERAL VIEWS OF THE DRAWINGS

There is shown:

FIG. 14 the detail "Z" in accordance with FIG. 12.

DETAILED DESCRIPTION OF THE INVENTION

Figure 1:
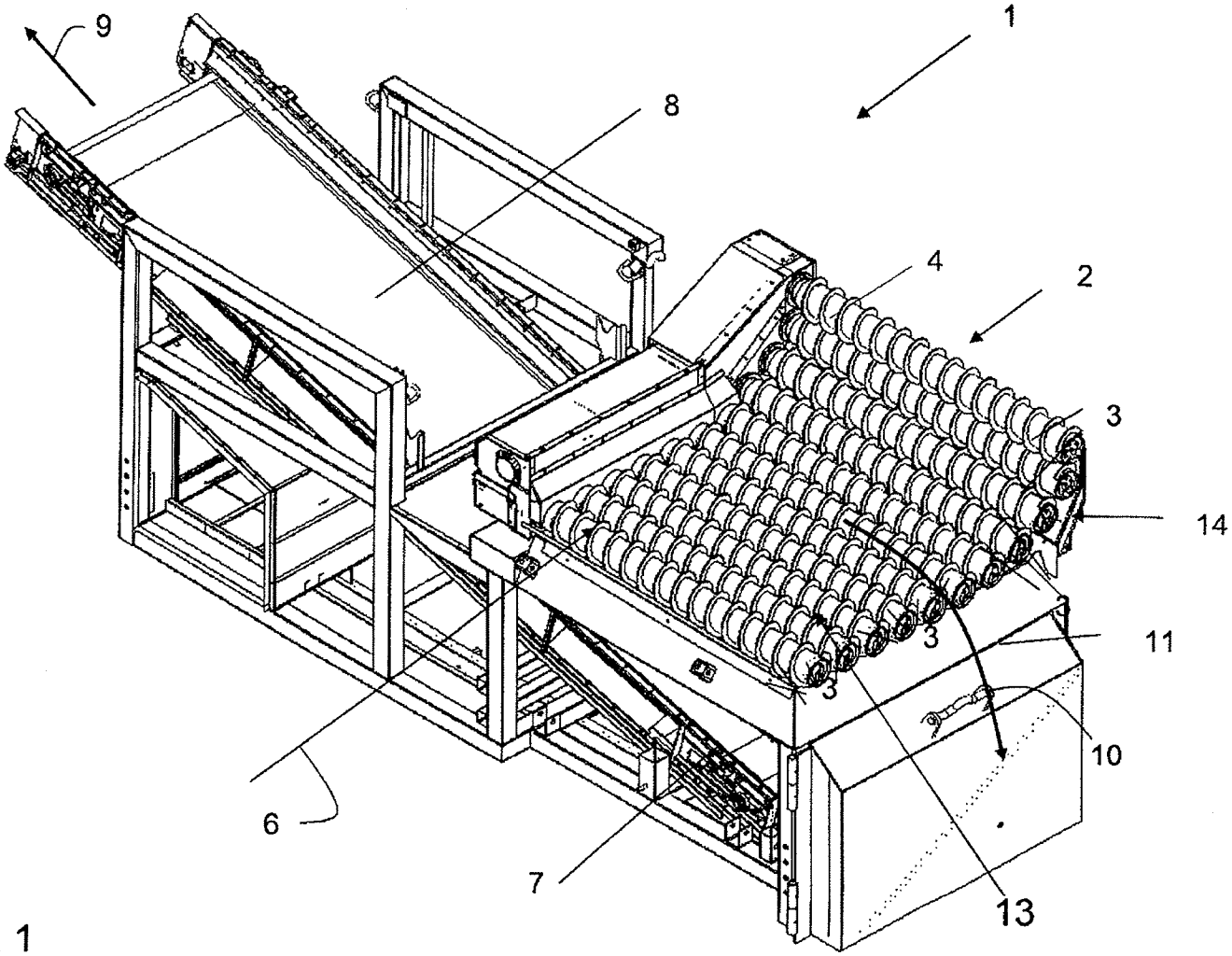
FIG. 1 an example embodiment of a device for sorting in accordance with the invention.

FIG. 1 shows an example embodiment of a device 1 for sorting in accordance with the invention, comprising a plurality of rotary elements 2 which are designed as helical rollers 3 comprising interlocking helices 4 or also as spiral rollers. Each of the rotary elements 2 rotates about a rotary axis of its own which respectively corresponds to the longitudinal centre (center) axis of each rotary element. The rotary axes are orientated parallel to each other, wherein the sorting surface formed by the rotary elements 2 is however designed so as to be level in a first partial region 4 and is curved in a second partial region 5. Sorting material is fed towards the region of the sorting surface opposite the curved second partial region 5, as indicated by the arrow 6.

The helical rollers 3 rotate clockwise, such that the introduced sorting material is transported towards the curved end of the sorting surface by the rotation of the helical rollers 3, wherein the undersize grain falls down between the helical rollers 3 and through a funnel 7 onto an undersize grain discharge belt 8 and is transported away, as indicated by the directional arrow 9. The oversize grain leaves the sorting surface via the free ends of the rotating helical rollers 3, as indicated in the figure by the directional arrow 10, wherein the oversize grain falls past a deflector 11 into a collecting container which is not shown in the figure.

Figure 2:
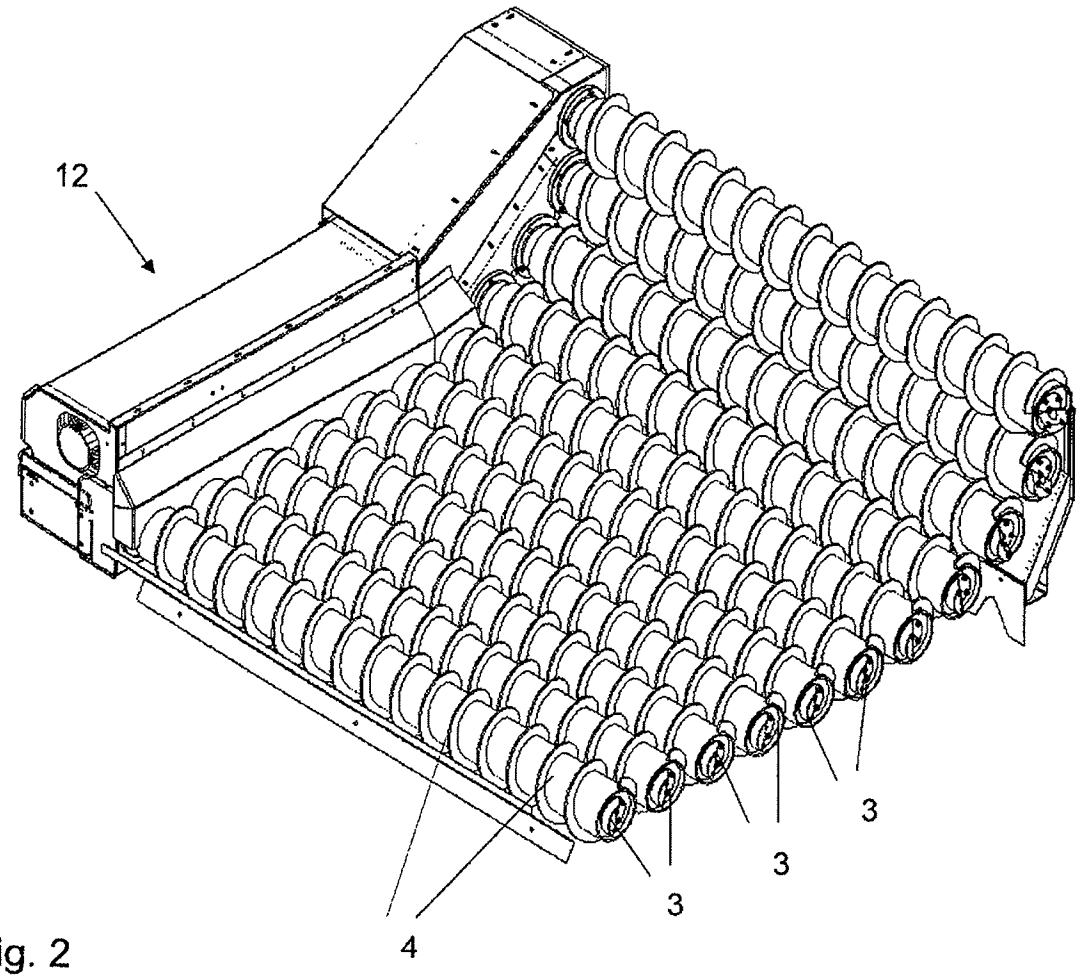
FIG. 2 a detailed view of the device for sorting in accordance with the invention.

FIG. 2 shows a detailed view of the example embodiment shown in FIG. 1. The detailed view clearly shows how the helical rollers 3 comprise interlocking helices 4, wherein all the helical rollers rotate in the same clockwise direction.

The helical rollers 3 are mounted on a drive/gear part 12 at one end.

Figure 3:
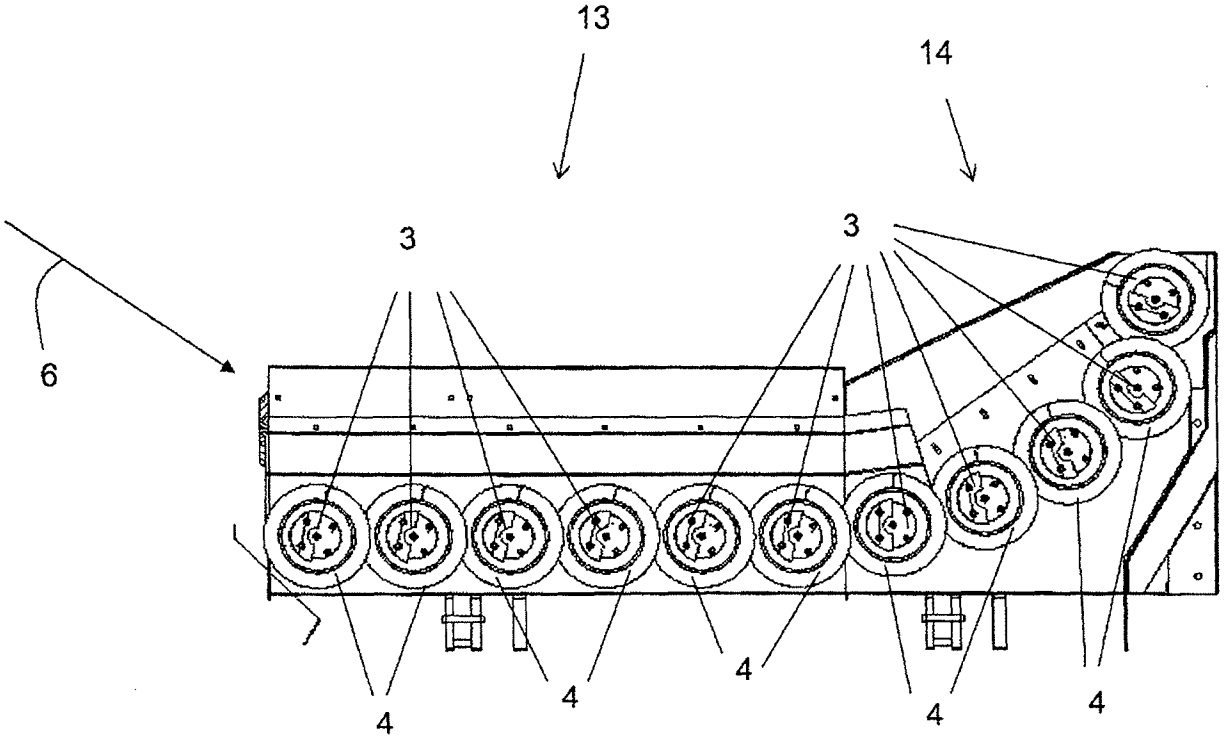
FIG. 3 a cross-sectional representation of a detail of the device for sorting in accordance with the invention.

FIG. 3 shows a detail of the example embodiment shown in FIG. 1, in a cross-sectional representation. This representation also shows how the helices 4 of the helical rollers 3 interlock. It can also clearly be seen how the first partial region 13 comprises a level sorting surface, while the second partial region 14 comprises a curved sorting surface.

As already mentioned, the sorting material is introduced onto the first helical roller of the level first partial region 4, as indicated by the directional arrow 6. The device is in particular suitable for separating clumped materials, such as for example rocks which are stuck together by mud, from each other and then making them available to the sorting process. This is ideally achieved by the sorting material being first transported along the first, level part of the sorting surface by the rotating helical rollers 3, wherein some of the undersize grain already falls down between the helical rollers 3. The rocks which are clumped together are transferred by the rotating rollers into the second partial region 14 which is curved upwards, causing the sorting material to roll back and tumble, thus breaking open the clumps and enabling the individual constituent parts to then be sorted.

A wall, or a rigid tube which does not rotate and is not provided with a helix, could be adjoined to the uppermost helical roller 3, in particular for shielding for safety reasons and/or to prevent sorting material from falling out. Alternatively, it would also be possible to provide a helical roller which exhibits an opposite direction of rotation and prevents material from spilling beyond the last helical roller 3.

Figure 4:
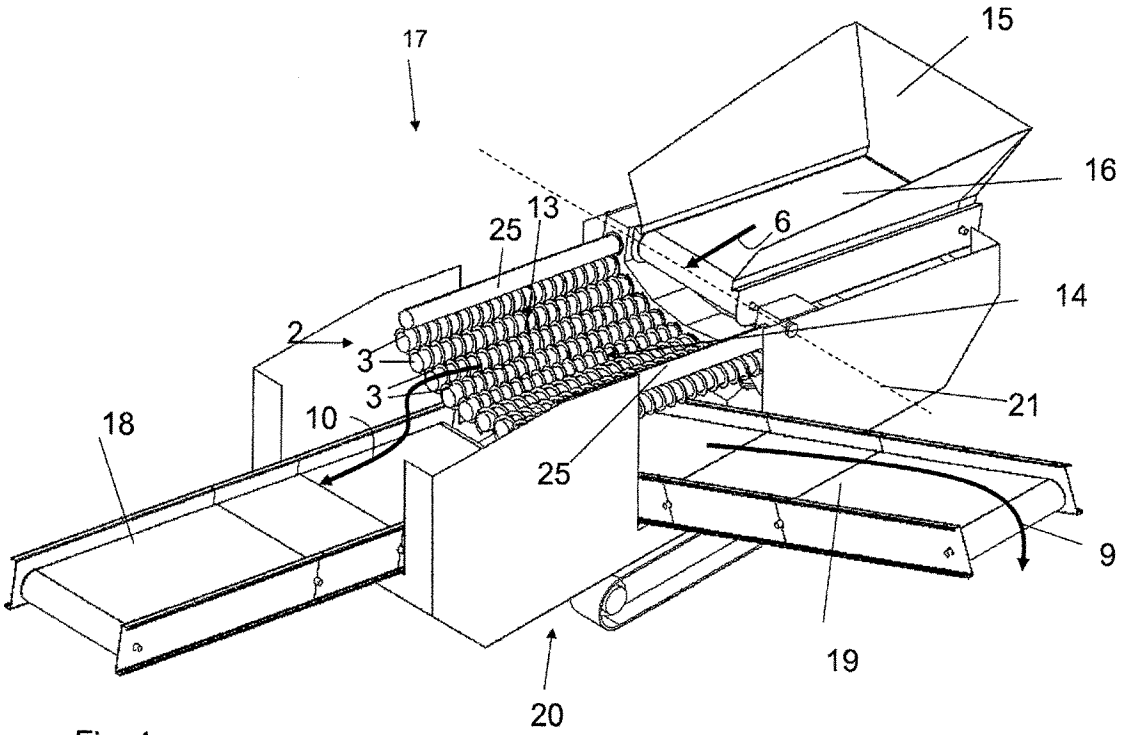
FIG. 4 another example embodiment of a device for sorting in accordance with the invention.

FIG. 4 shows another example embodiment of a device for sorting in accordance with the invention. In this example embodiment, the rotary elements are formed by helical rollers 3 and arranged such that the sorting surface 17 formed by them is curved in the shape of a depression, with a cross-section in the shape of a parabola. In this device, the helical rollers 3 which are arranged in a first partial region 13 exhibit a different direction of rotation to the rotary elements 2 which are arranged in a second partial region 14 which is different from the first partial region 13.

Specifically, the direction of rotation of the helical rollers 3 is chosen such that they always exert a force on the sorting material which is orientated towards the bottom of the depression. The sorting material is introduced via an introducing funnel 15 and a transporting belt 16 onto the sorting surface 17 foamed by the rotary elements 2, as indicated by the directional arrow 6. The oversize grain leaves the sorting surface 17 past the free ends of the helical rollers 3 and falls onto an oversize grain outlet belt 18, as indicated by the directional arrow 10. The undersize grain falls down between the helical rollers 3 and ultimately leaves the sorting surface 17 via an undersize grain outlet belt 19, as indicated by the directional arrow 9. The device for sorting is fitted with a tracked undercarriage 20 which facilitates its use in mobile applications.

The sorting surface 17 formed by the rotary elements 2 can be pivoted about a pivot axis 21, thus enabling it to be made more difficult for material to be expelled via the free ends, by adding a weight component, or easier. It is thus possible, by positioning the sorting surface 17 more steeply, to increase the dwelling time of the sorting material on the sorting surface 17 and therefore improve the sorting result with respect to accuracy. Lastly, setting the inclination of the sorting surface 17 influences the ratio of the amount of expelled undersize grain to expelled oversize grain.

Figure 5:
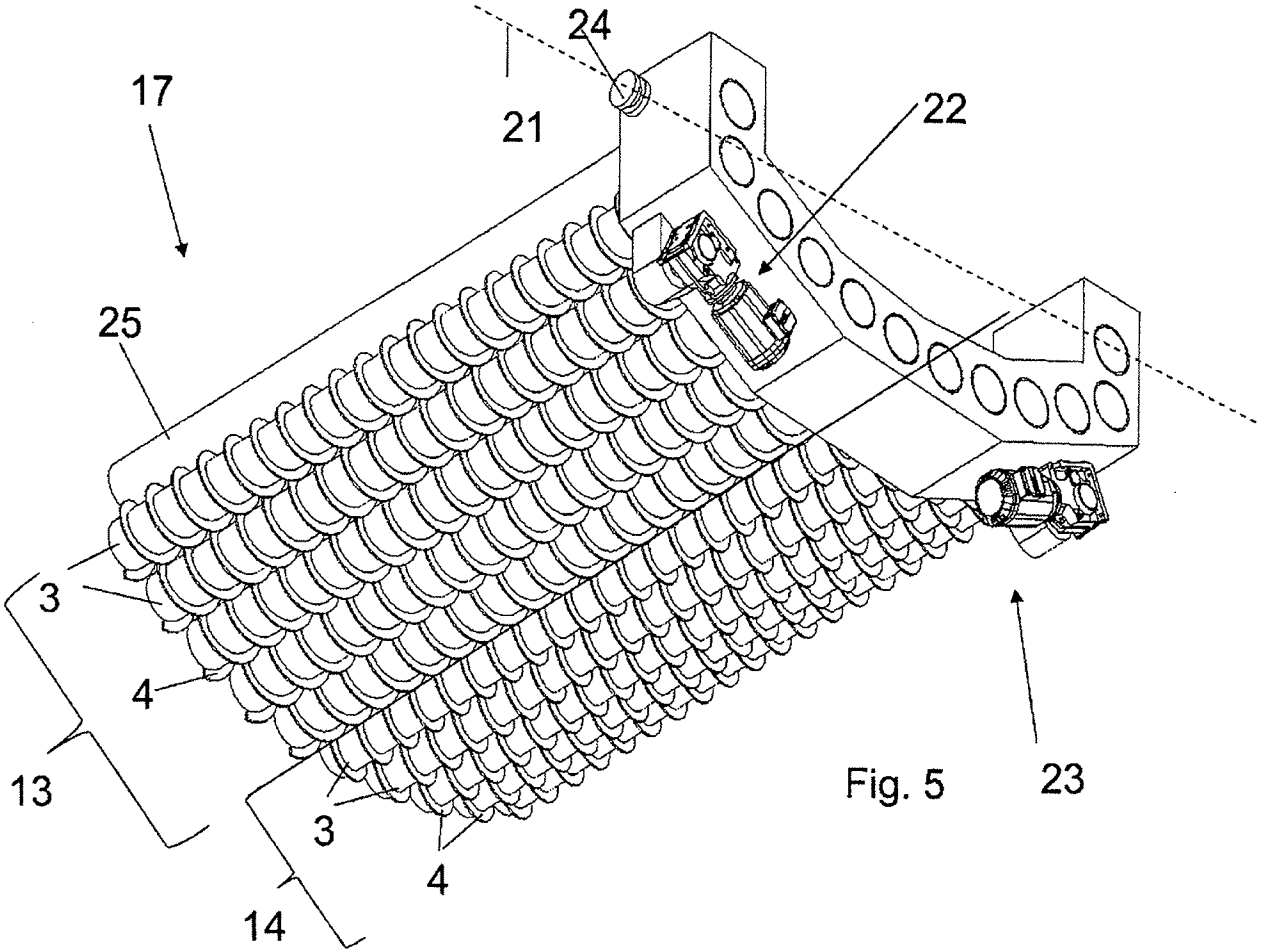
FIG. 5 a detailed view of said other example embodiment.

FIG. 5 shows the part of the device for sorting which includes the sorting surface 17. It can clearly be seen how the helices 4 of the helical rollers 3 of the first region 13 interlock. These helical rollers 3 rotate in the same direction of rotation.

The helical rollers 3 of the second region 14 likewise comprise interlocking helices 4 and rotate in a direction of rotation which is opposite to that of the helical rollers 3 of the first region 13. These helical rollers 3 also exhibit a different coiling direction, with respect to their helices 4, to the helical rollers 3 from the first region 13.

The helices 4 of the two mutually adjacent helical rollers 3 which exhibit opposite directions of rotation and opposite coiling directions of their helices 4 interlock in the example embodiment shown. The rotational speeds of all the helical rollers 3 therefore have to be identical so as not to cause jamming. Alternatively, it would also be possible for the two mutually adjacent helical rollers 3 which exhibit opposite directions of rotation to not interlock. In this case, different rotational speeds between the helical rollers 3 of the different regions 13, 14 are also possible.

A first drive 22, which is embodied as a gear motor, is provided for the helical rollers of the first region 13. A second drive 23, which is likewise designed as a gear motor, is provided for the helical rollers of the second partial region 14. A receptacle 24 for pivotally mounting about the pivot axis 21 can also clearly be seen in the figure.

In order to prevent the sorting material from inadvertently falling over the raised sides of the sorting surface 17, rigid steel tubes 25 which do not rotate are arranged parallel to the helical rollers 3 and adjoining the peripheral sorting rollers 3.

Figure 6:
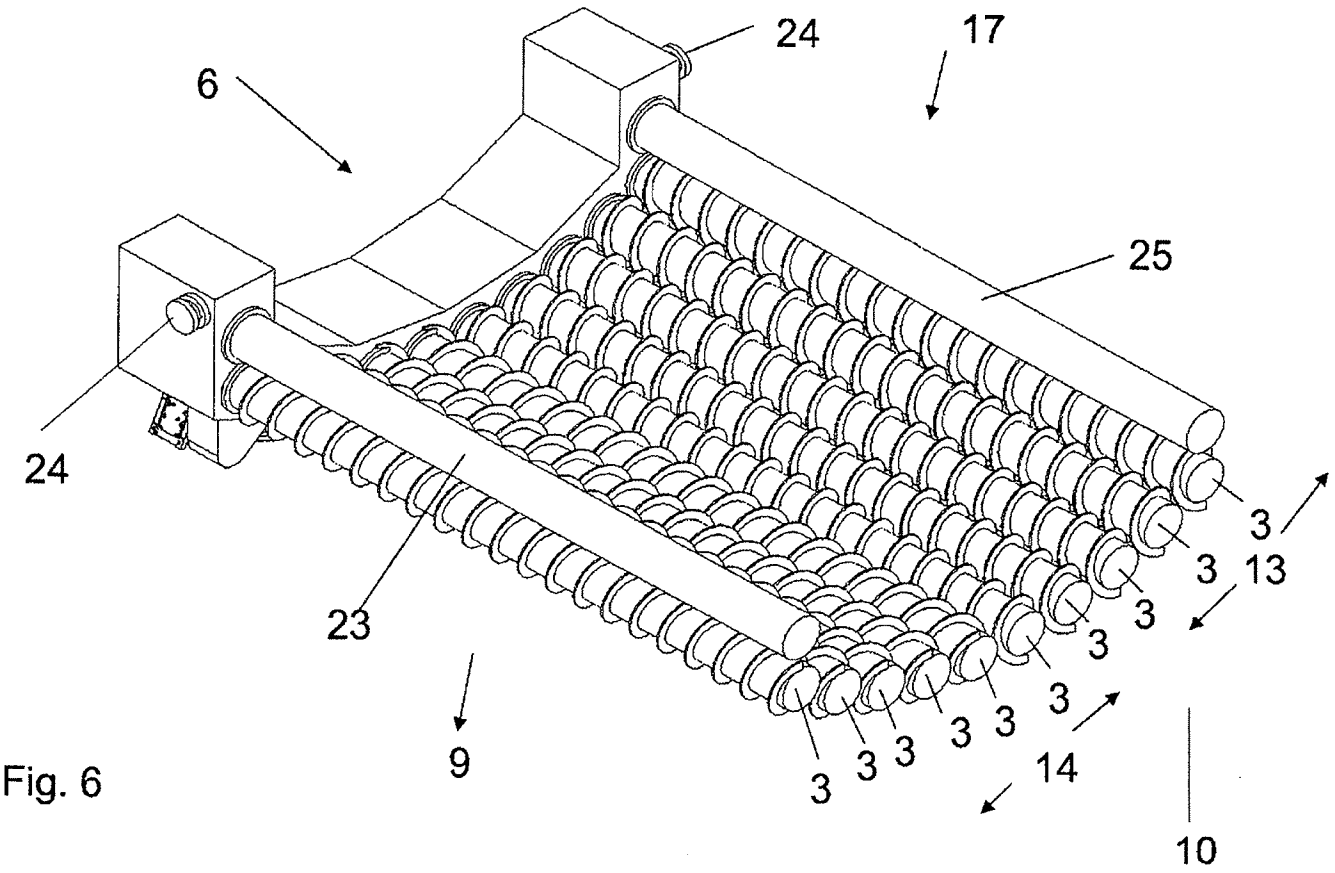
FIG. 6 another detailed view of the example embodiment in accordance with the invention.

FIG. 6 shows a different, perspective view of the detail of the device for sorting which has already been shown in FIG. 5. The material is introduced in the direction indicated by the arrow bearing the reference sign 6. The undersize grain leaves the sorting surface 17 in the direction indicated by the arrow bearing the reference sign 9. The oversize grain leaves the sorting surface 17 in the direction indicated by the directional arrow 10.

Figure 7:
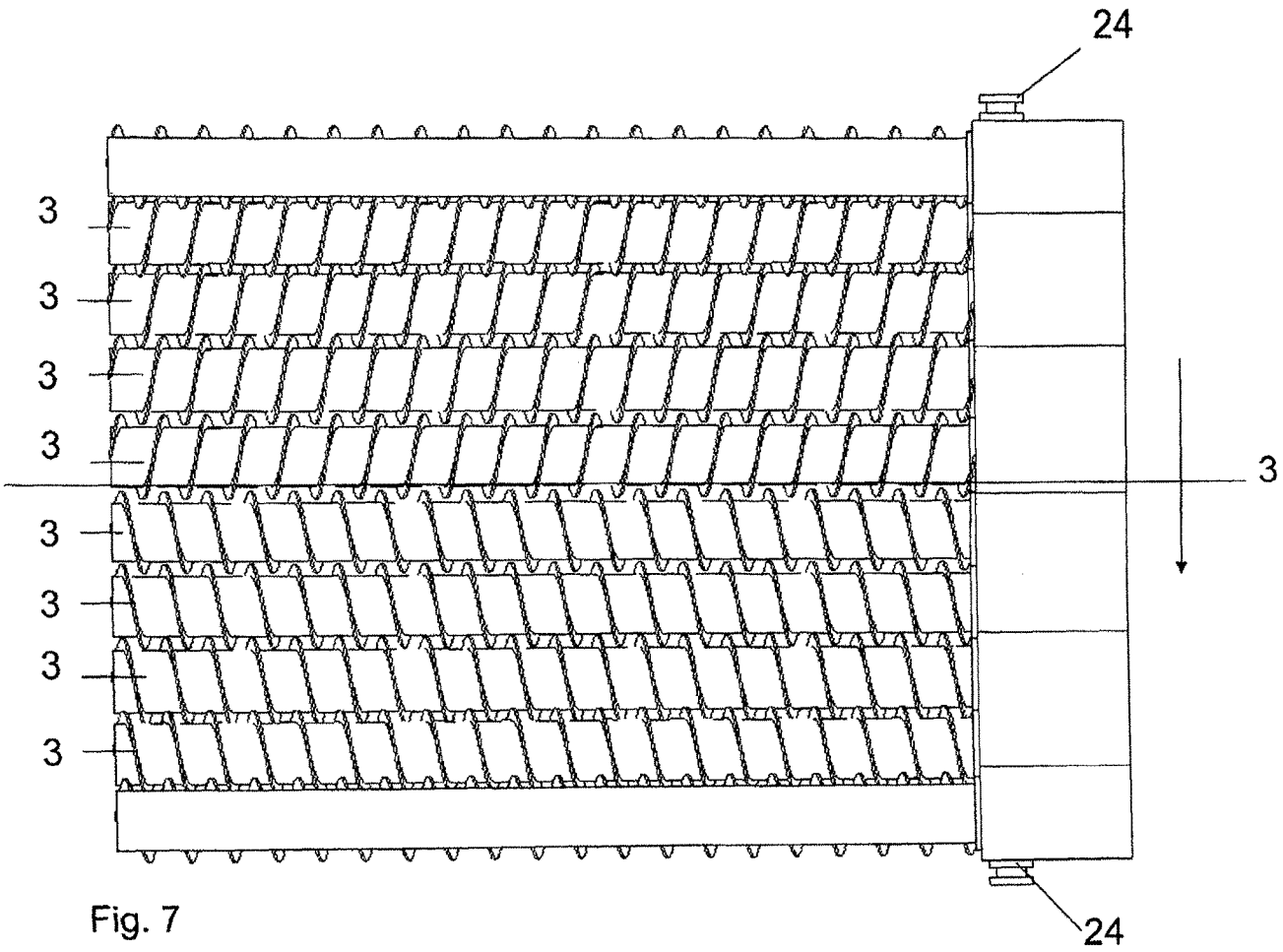
FIG. 7 a plan view onto a detail of said other example embodiment.

FIG. 7 shows the sorting surface 17 in a plan view. The two regions which respectively comprise helical rollers 3 exhibiting different rotary directions and different coiling directions of their helices 4 can in particular be seen.

Figure 8:
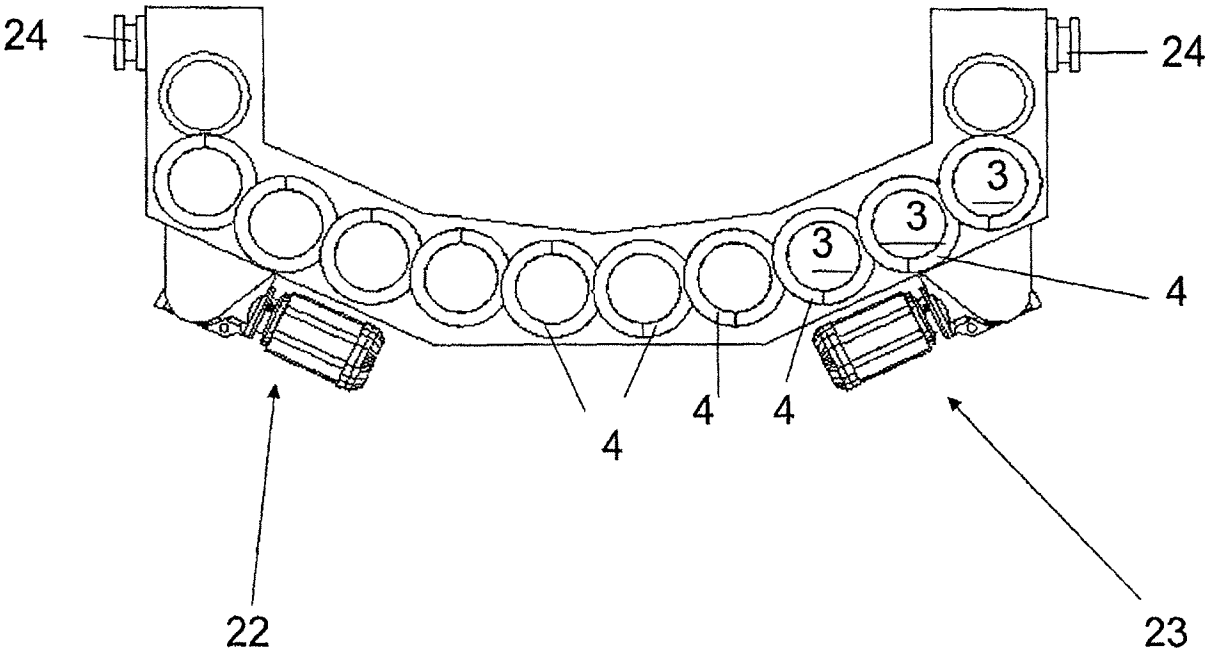
FIG. 8 a cross-sectional representation of a detail of said other example embodiment.

FIG. 8 shows a cross-sectional representation of the detail which has already been shown in FIGS. 5 to 7. It clearly shows how the helices 4 of the helical rollers 3 interlock. The receptacles 24 for pivotally mounting, and also the drives 22, 23, are also indicated.

Figure 9:
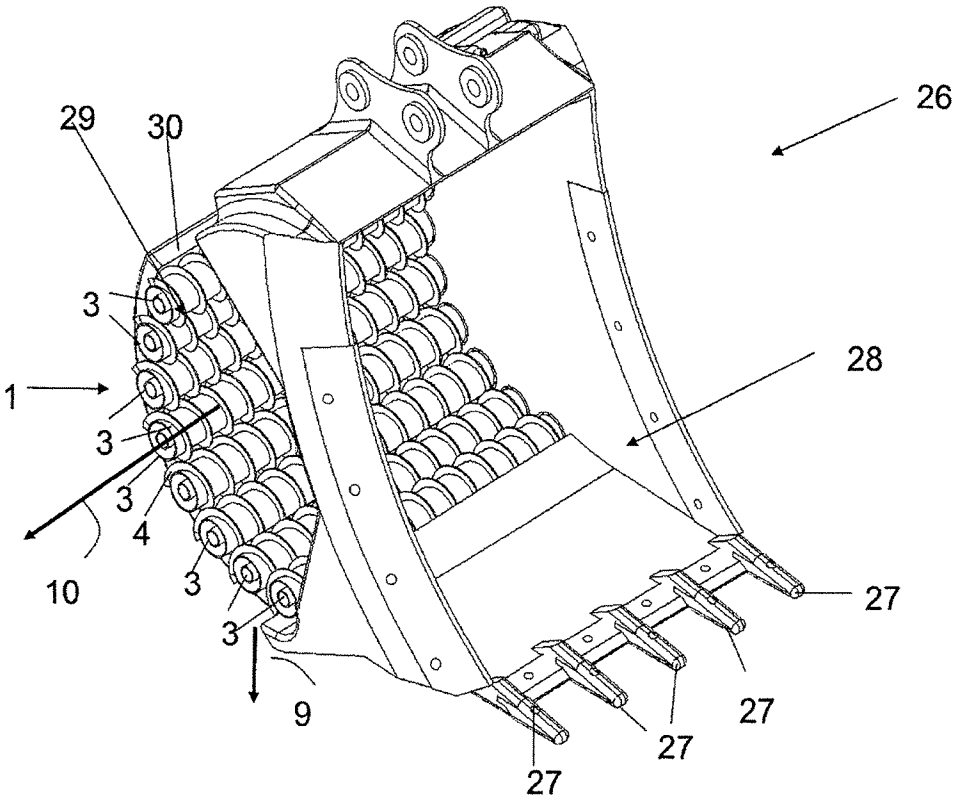
FIG. 9 an example embodiment of a digger's scoop comprising a device for sorting in accordance with the invention, in a perspective view.

FIG. 9 shows a digger's scoop 26 comprising a device 1 for sorting in accordance with the invention. The digger's scoop comprises helical rollers 3 which are mounted at one end and each provided with a helix 4. The sorting material is introduced into the digger's scoop via the filling opening 28 which is provided with teeth 27.

The digger's scoop comprises a lateral opening 29 for expelling the oversize grain, which is different from the filling opening. The oversize grain leaves the device for sorting via this lateral expelling opening 29, as indicated by the directional arrow 10. The undersize grain leaves the device for sorting downwards through the intermediate spaces of the helical rollers 3. The digger's scoop comprises a support bracket 30, adjacent to the helical rollers 3, for stabilising (stabilizing) the digger's scoop.

Figure 10:
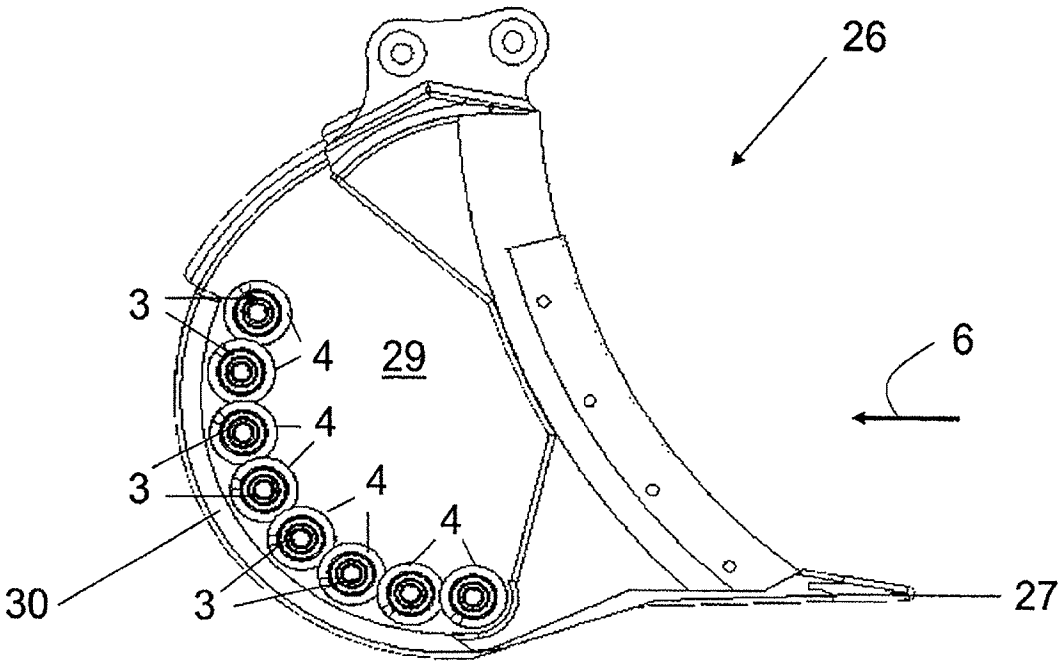
FIG. 10 the example embodiment of a digger's scoop, in a cross-sectional representation.

FIG. 10 shows the digger's scoop in a cross-sectional representation which shows how the helices 4 of the helical rollers 3 interlock. This figure also shows the location of the support bracket 30.

The oversize grain leaves the digger's scoop 26 through the expelling opening 29 which is provided for this purpose, i.e. in relation to the figure shown, towards the observer. Material to be sorted is fed in the direction of the arrow which is provided with the reference sign 6.

Figure 11:
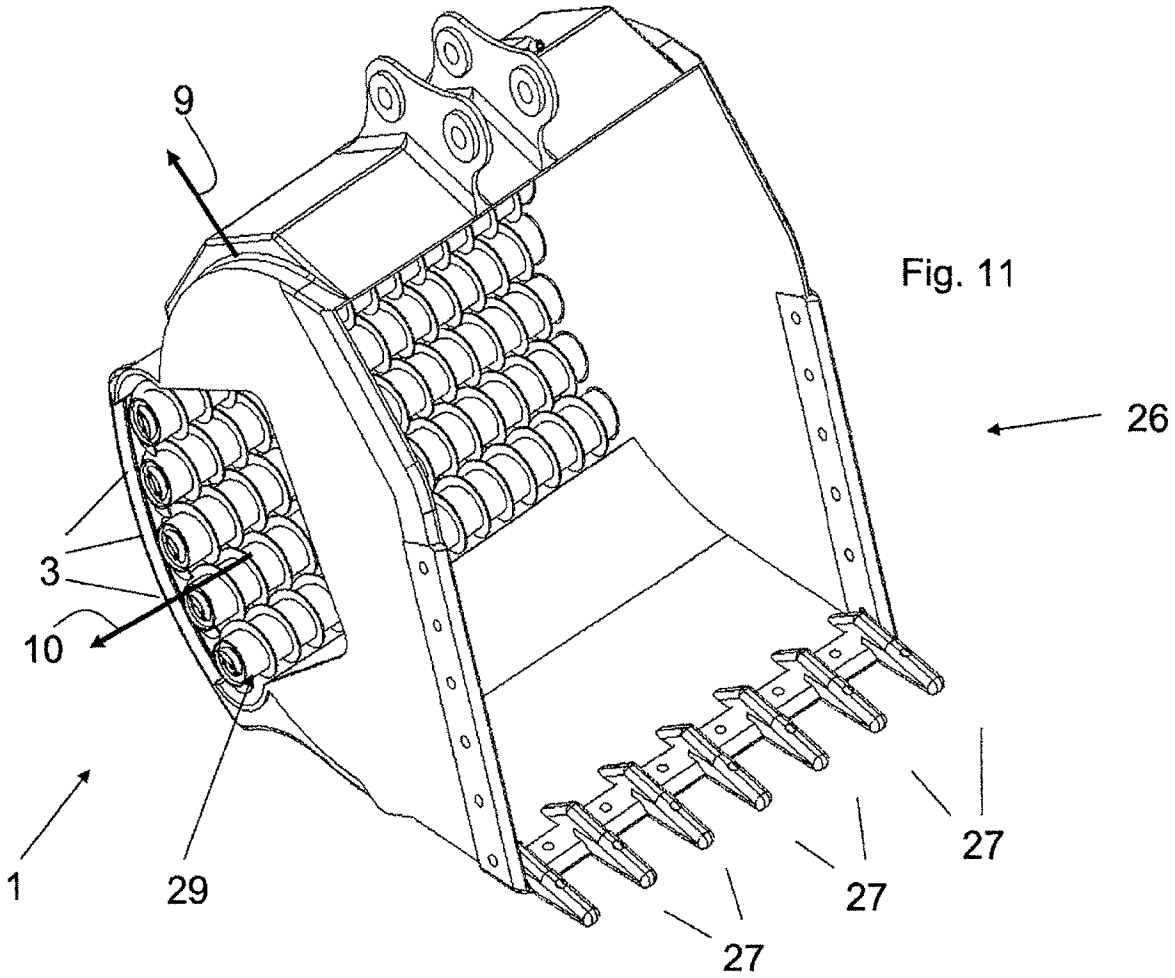
FIG. 11 another example embodiment of a digger's scoop comprising a device for sorting.

FIG. 11 shows an alternative embodiment of a digger's scoop 26 comprising a device 1 for sorting in accordance with the invention. In this embodiment, the oversize grain is likewise expelled through a separate expelling opening 29 along the path indicated by the directional arrow bearing the reference sign 10. The undersize grain leaves the digger's scoop through the intermediate spaces between the helical rollers 3 along the path indicated by the directional arrow bearing the reference sign 9.

Figure 12:
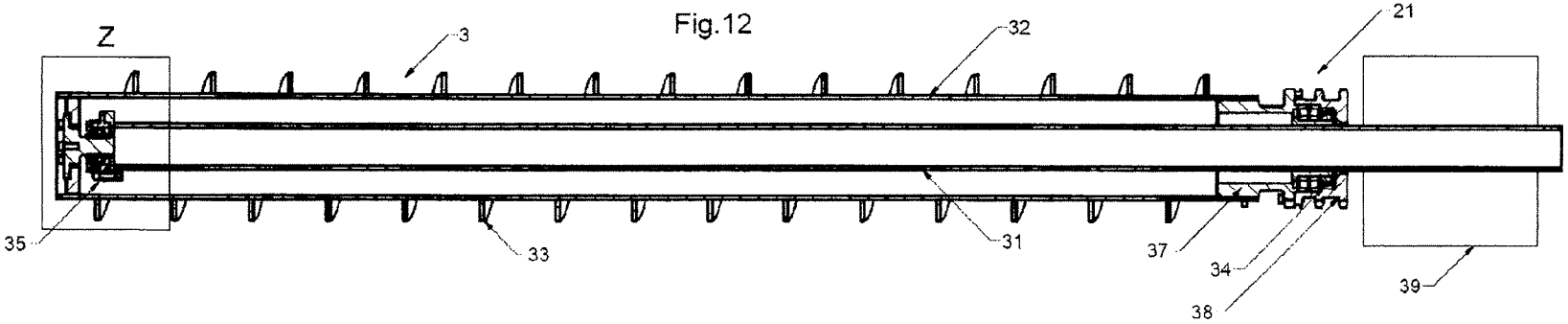
FIG. 12 one possible embodiment of a helical roller comprising an interior core tube and an outer tube casing which bears the spiral and/or helix.
Figure 13:
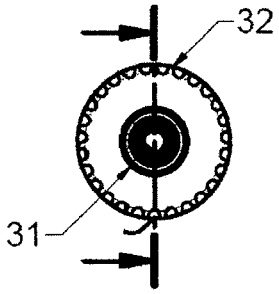
FIG. 13 a representation of the cross-section of the helical roller in accordance with FIG. 12, in the region of the free end of the helical roller.

FIGS. 12 to 14 show an embodiment of a helical roller 3 which can in particular be used for larger designs, wherein the helical roller 3 comprises a core tube 31 which is stationary in the example embodiment chosen here and which protrudes into the tube casing 32 up to at least half the length of the tube casing 32. The outer tube casing 32 bears the spirals 33.

In the example embodiment in accordance with FIG. 12, the core tube 31 protrudes almost as far as the free end of the tube casing 32, wherein the tube casing 32 and the core tube 31 are in contact with each other via two bearings 34, 35. This internal design massively reduces oscillations and imbalances within the helical rollers 3. The tube casing 32 is effectively mounted on a projecting core tube 31 at both ends.

The detailed image in accordance with FIG. 14 in particular shows how the tube casing 32 is mounted on the core tube 31, wherein the free end of the tube casing 32 is received, via a journal 36, in the bearing 35 which is situated at the end of the core tube 31. On the opposite end, the tube casing 32 comprises a rotational part 37 which is mounted in a second bearing 34. The drive-end bearing 34 is enclosed by a sprocket 38 which is designed as a rotational part and via which the tube casing 32 is driven. The reference sign 39 denotes the terminal box in which the stationary core tube 31 is received.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

LIST OF REFERENCE SIGNS

1 device
2 rotary element
3 helical roller
4 partial region/helix
5 second partial region
6 arrow
7 funnel
8 undersize grain discharge belt
9 directional arrow
10 directional arrow
11 deflector
12 drive/gear part
13 partial region
14 second region
15 introducing funnel
16 transporting belt
17 sorting surface
18 outlet belt
19 undersize grain outlet belt
20 tracked undercarriage
21 pivot axis
22 drive
23 drive
24 receptacle
25 steel tube
26 digger's scoop
27 tooth
28 filling opening
29 expelling opening
30 support bracket
31 core tube
32 tube casing
33 spiral, helix
34 bearing
35 bearing
36 journal
37 rotational part
38 sprocket
39 terminal box

The invention claimed is:

1. A device for sorting, comprising:

a plurality of helical rollers, each roller exhibiting at least one helix, wherein each helical roller is rotatable about a rotary axis of its own, at least two adjacent helical rollers are rotatable in a same direction of rotation, and the rotary axes of at least three helical rollers are not arranged in a common plane, and the plurality of helical rollers together form a sorting surface that is curved at least in a partial region thereof so that a force generated by weight of a sorting material to be sorted with the device for sorting is exerted onto the sorting material in said curved partial region;

wherein all of the helical rollers are held and rotatably mounted exclusively at one end; and wherein the sorting surface formed by the plurality of helical rollers is pivotable about a pivot axis that is arranged in a plane which is perpendicular to the rotary axes.

2. The device for sorting according to claim 1, wherein the rotary axes of the helical rollers are orientated parallel to each other.

3. The device for sorting according to claim 1, wherein the sorting surface formed by the helical rollers forms a depression or part of a depression.

4. The device for sorting according to claim 1, wherein at least two helical rollers exhibit different directions of rotation.

5. The device for sorting according to claim 1, wherein:

a. two or more of the helical rollers in a first partial region of the sorting surface exhibit the same first direction of rotation, and two or more of the helical rollers in a second partial region of the sorting surface which is different from the first partial region exhibit a direction of rotation which is opposite to the first direction of rotation; and b. mutually adjacent helical rollers in the first partial region of the sorting surface exhibit the same first direction of rotation, and mutually adjacent helical rollers in the second partial region of the sorting surface which is different from the first partial region exhibit a direction of rotation which is opposite to the first direction of rotation.

6. The device for sorting according to claim 5, wherein a center of the sorting surface or a lowest point on a depression of the sorting surface formed by the helical rollers is arranged between the first partial region and the second partial region.

7. The device for sorting according to claim 1, wherein:

a. the helices of the helical rollers in a first partial region of the sorting surface exhibit a different coiling direction to the helices of the helical rollers in a second partial region of the sorting surface which is different from the first partial region, or b. the helices of mutually adjacent helical rollers in a first partial region of the sorting surface of the device exhibit a different coiling direction to the helices of mutually adjacent helical rollers in a second partial region of the sorting surface which is different from the first partial region.

8. The device according to claim 7, wherein the helices of mutually adjacent helical rollers interlock at least in a partial region, or the helices of mutually adjacent helical rollers of the partial regions of the sorting surface each interlock in the same direction of rotation, or the helices of all mutually adjacent helical rollers interlock.

9. The device according to claim 1 wherein:

a. a direction for introducing material to be sorted is defined which is orientated parallel to the rotary axis of at least one helical roller, or b. a direction for introducing material to be sorted is defined which is orientated perpendicular to the rotary axis of at least one helical roller.

10. The device according to claim 1 wherein:

a. when in operation, the device simultaneously produces at least two fractions from material sorted by the device which are spatially separate from each other, or b. when in operation, the device simultaneously produces at least two fractions from material sorted by the device which are spatially separate from each other and simultaneously expels them.

11. The device according to claim 1, wherein the helical rollers that are held and rotatably mounted at one end comprise a core tube on which an outer tube casing is rotatably mounted which bears the helix.

12. The device according to claim 11, wherein the core tube extends over only some of the length of the tube casing.

13. The device according to claim 12, wherein at least one mount between the core tube and the tube casing is arranged in a region of a drive for the helical roller.

14. A construction machine, comprising a device for sorting according to claim 1.

15. A digger's scoop, comprising:

a device for sorting that has a plurality of helical rollers, each roller exhibiting at least one helix, wherein each helical roller is rotatable about a rotary axis of its own, at least two adjacent helical rollers are rotatable in a same direction of rotation, and the rotary axes of at least three helical rollers are not arranged in a common plane, and wherein all of the helical rollers are held and rotatably mounted exclusively at one end, with the opposite ends of the helical rollers not held or mounted;

said device defining a filling opening for receiving material to be sorted; and said device further defining a lateral opening which is different from the filling opening and is located in a side wall of the scoop adjacent to and in front of said opposite ends of the helical rollers not held or mounted for expelling material sorted by the device that has an oversize grain size from the opposite ends of the helical rollers, wherein material sorted by the device of a finer grain size is expelled between the rollers.

16. The digger's scoop according to claim 15, further comprising a drive device for rotating the helical rollers.

* * * * *